US010098474B2

(12) United States Patent
Häger et al.

(10) Patent No.: US 10,098,474 B2
(45) Date of Patent: Oct. 16, 2018

(54) INDIVIDUALLY POCKETED COIL SPRINGS WITH CUSHIONING PADS, AND POCKET SPRING MATTRESSES WITH SUCH POCKETED COIL SPRINGS

(71) Applicants: Starsprings AB, Herrljunga (SE); Carpe Diem Beds of Sweden AB, Lysekil (SE)

(72) Inventors: Bengt Häger, Vinninga (SE); Robert Ahlqvist, Vargarda (SE); Kenneth Edling, Herrljunga (SE); Jörgen Thuresson, Lysekil (SE)

(73) Assignees: STARSPRINGS AB, Herrljunga (SE); CARPE DIEM BEDS OF SWEDEN AB, Lysekil (SE)

( * ) Notice: Subject to any disclaimer, the term of this patent is extended or adjusted under 35 U.S.C. 154(b) by 0 days.

(21) Appl. No.: 14/780,211

(22) PCT Filed: Apr. 8, 2014

(86) PCT No.: PCT/EP2014/057011
§ 371 (c)(1),
(2) Date: Sep. 25, 2015

(87) PCT Pub. No.: WO2014/166927
PCT Pub. Date: Oct. 16, 2014

(65) Prior Publication Data

US 2016/0045034 A1 Feb. 18, 2016

(30) Foreign Application Priority Data

Apr. 8, 2014 (EP) ..... 13162725

(51) Int. Cl.
*A47C 27/06* (2006.01)
*A47C 27/045* (2006.01)
*A47C 27/05* (2006.01)

(52) U.S. Cl.
CPC ..... *A47C 27/064* (2013.01); *A47C 27/045* (2013.01); *A47C 27/053* (2013.01)

(58) Field of Classification Search
CPC ..... A47C 27/064–27/07; A47C 27/04; A47C 27/045; A47C 27/053; A47G 9/1027
See application file for complete search history.

(56) References Cited

U.S. PATENT DOCUMENTS 1,834,546 A * 12/1931 Micon ..... A47C 27/05 5/720
6,397,418 B1 6/2002 Stjerna
(Continued)

FOREIGN PATENT DOCUMENTS

EP 1330171 A1 7/2003
RU 52311 U1 3/2006
(Continued)

OTHER PUBLICATIONS

New Zealand First Examination Report for Corresponding Patent Application No. 713019 dated Jul. 26, 2017.
(Continued)

*Primary Examiner* — Nicholas F Polito
*Assistant Examiner* — Amanda L Bailey
(74) *Attorney, Agent, or Firm* — Harness, Dickey & Pierce, P.L.C.

(57) ABSTRACT

An individually pocketed coil spring for use in a bedding or seating product, is disclosed, as well as pocket spring mattresses including such pocketed coil springs. The individually pocketed coil spring include: a coil spring having an upper end and a lower end; a casing forming a pocket enclosing said coil spring; and a cushioning pad located above said upper end of the coil spring. The casing provides a first compartment enclosing the coil spring, and a second
(Continued)

compartment enclosing the cushioning pad. The first and second compartments are separated from each other.

18 Claims, 5 Drawing Sheets

(56) References Cited

U.S. PATENT DOCUMENTS

| | | | | |
|---|---|---|---|---|
| 6,490,744 | B1 | 12/2002 | Schulz, Jr. | |
| 6,523,812 | B1 * | 2/2003 | Spinks | A47C 27/001 267/166 |
| 2005/0273939 | A1 * | 12/2005 | Mossbeck | A47C 23/047 5/720 |

FOREIGN PATENT DOCUMENTS

| | | | | |
|---|---|---|---|---|
| UA | 14936 | U | 6/2006 | |
| WO | WO 2005053466 | A1 * | 6/2005 | A47C 23/047 |

OTHER PUBLICATIONS

Search Report for Russian Patent Application No. 2015140495/12 dated Nov. 14, 2017 and English translation thereof.
Office Action for U.S. Appl. No. 16/016,807 dated Jul. 27, 2018.

* cited by examiner

INDIVIDUALLY POCKETED COIL SPRINGS WITH CUSHIONING PADS, AND POCKET SPRING MATTRESSES WITH SUCH POCKETED COIL SPRINGS

FIELD OF THE INVENTION

The present invention relates to an individually pocketed coil spring, and a pocket mattress comprising such individually pocketed coil springs, for use in mattresses, cushions and other bedding or seating products.

BACKGROUND OF THE INVENTION

A common technique of making spring mattresses is the so-called pocket technique. This means that the springs are enclosed in pockets, i.e. they are individually enclosed by a casing material. In this way, the springs will be relatively individually resilient so that they can flex individually without affecting the neighboring springs and, thus, the comfort for the user increases since his weight will be distributed more uniformly over the surface that receives the load.

A known form of pocketed spring assembly comprises a plurality of parallel strings of springs joined together by gluing, clipping, welding or the like, thereby securing the strings of springs to each other. Each string of springs comprises a strip of fabric wrapped around a plurality of coil springs which are aligned in a row. The strings may extend in the mattress' width or length direction.

In order to create such a string of springs, a plurality of coil springs are aligned in a row and a strip of fabric is wrapped around the aligned row of coil springs so as to create two plies, one on either side of the row of springs. The edges of the strip of fabric are joined together with a longitudinal line of attachment extending longitudinally along the row of springs. The outermost edges of the strip of fabric are joined together with outermost transverse lines of attachment in order to prevent the outermost springs from falling out of the strip of fabric. Between adjacent coil springs transverse lines of attachment extend generally parallel to the axis of the coil springs, separating the strip of fabric into individual pockets, each pocket containing a coil spring.

However, lying directly on the pocket mattress is normally not comfortable, and in order to provide good sleeping and resting comfort, it is normally required to add a layer of padding or the like on top of the mattress. Such a padding layer is often assembled together with the pocket mattress, to form an encased upholstered mattress. Alternatively, a separate padding mattress may be laid loosely on top of the pocket spring mattress. A drawback of such an additional top layer is, however, that this reduces the individual resilience of the pocket units, and provides a less than optimal pressure distribution.

To this end, it has been proposed in EP1 330 171 to connect foam or other cushioning or padding materials to the top of each coil spring, and to encase each such unit of foam/padding and coil spring, within each individual pocket. This provides an additional padding layer which maintains the inherent individual resilience of the pocket spring mattress.

However, a drawback of this previously proposed mattress is that connection of the foam/padding to the coil spring is relatively complicated and costly to achieve. Further, there is a sever risk that the foam/padding will be deformed or disconnected, and e.g. be pushed into the convolutions of the coil spring. This will significantly deteriorate both the appearance and the comfort of the mattress.

There is a therefore a need for individual pocketed coil springs and a pocket spring mattress which is easier and/or less expensive to manufacture but which at the same time provides at least an equivalent comfort compared with other prior-art pocket mattresses. It is also a need for such individual pocketed coil springs and pocket spring mattresses that delivers improved resiliency and responsiveness and that enables the use of reduced amounts of cushioning or padding material on top of the bedding or seating product once the spring assembly is complete. Still further, there is a need for such individual pocketed coil springs and pocket spring mattresses that are more robust and which maintains their properties over a prolonged period of time and use.

SUMMARY OF THE INVENTION

It is therefore an object of the present invention to at least partly overcome these problems, and to provide an improved individually pocketed coil spring, and an improved pocket spring mattress comprising such individually pocketed coil springs.

These, and other objects that will be apparent from the following, are achieved by an individually pocketed coil spring and a pocket spring mattress according to the appended claims.

According to a first aspect of the invention there is provided an individually pocketed coil spring for use in a bedding or seating product, said individually pocketed coil spring comprising:

a coil spring having an upper end and a lower end;

a casing forming a pocket enclosing said coil spring; and a cushioning pad located above said upper end of the coil spring;

wherein the casing provides a first compartment enclosing the coil spring, and a second compartment enclosing the cushioning pad, said first and second compartment being separated from each other.

The present invention provides individually pocketed coil springs each comprising a cushioning pad, preferably positioned essentially straight above the corresponding coil spring. By the provision of at least one cushioning pad within each individual pocket, each coil spring functions independently, resulting in a more comfortable bedding or seating product. Hereby, the individual resilience of the pockets is maintained, providing excellent comfort and pressure distribution. For such pocket units, there is no need for additional padding layers, since a cushioning pad is already incorporated in each pocket unit.

Further, manufacturing of such pocket units is relatively simple and cost-efficient, since there is no need to connect the cushioning pad directly to the coil springs. Instead, the cushioning pad is arranged in a separate compartment, arranged on top of the pocket enclosing the coil spring. This makes it possible to use a conventional manufacturing process for making pocket mattresses, and to simply add a separate compartment on top of each pocket unit to incorporate the cushioning pad. Hereby, the present invention lends itself very well to automated and cost-efficient manufacturing, and it is also relatively simple to incorporate the additional steps of providing a separate compartment for the cushioning pad and to insert such cushioning pads into said compartments in previously known and used manufacturing processes.

Further, the fact that the coil spring and the cushioning pad in each pocket unit is separated from each other, and arranged in separate compartments, ensures that the cushioning pad will always remain in place. The casing material of the compartment encasing the coil spring hinders the cushioning pad of getting displaced during use. Consequently, the appearance and the comfort of the mattress will be maintained even during prolonged period of use.

Thus, each pocket may here be seen as a common external cover, and a common partition wall connected to or integrated with the external cover, and extending between the coil spring and the cushioning pad, thereby separating the two compartments.

The extension of the partition wall between the junctions to the external cover preferably exceeds that of the lateral dimensions of the coil springs and the cushioning pads. Owing to this arrangement, the part of the partition wall against which the spring and cushioning pad abut is moveable between an upper and a lower end position, without affecting the external cover at the areas of junction of the partition wall to the external cover. In this manner, each pair of springs and cushioning pads may flex individually between these end positions within the area of extension inside the pocket. Such an arrangement of a partition wall being moveable between an upper and lower end position is per se known from U.S. Pat. No. 6,397,418 by the same applicant, said document hereby being incorporated in its entirety by reference.

The dimensions of the pocket, i.e. the external cover, the coil springs and the cushioning pads are preferably such that the coil springs are maintained in a biased, state, and wherein the partition walls not being in the upper end position, when no external pressure is applied. Preferably, the partition walls are also not in the lower end position, but somewhere between these end positions. Hereby, the pocket units become even more independently resilient. Further, this ensures that the overall dimensions of the pocket units will be maintained even if the dimensions of the cushioning pads are altered during use. It is e.g. common that cushioning pads of this type will lose some of their initial shape during use, and e.g. lose some of their initial thickness. However, the biased coil spring and the partition wall not being in the upper most position will compensate for this, and the upper surface of the pocket units and the mattress will be maintained in the same shape and position. Thus, a mattress comprising such pocket units will maintain its smooth and even upper surface, and consequently its original appearance, even after a substantial period of use, and even when some deterioration of the cushioning pads have occurred.

The casing preferably comprises a first piece of fabric forming said first compartment, and a second piece of fabric forming said second compartment. Hereby, the first piece of fabric may be used in a conventional way, for providing individually pocketed coil springs, and a second piece of fabric may then be added to provide the additional compartment for housing the cushioning pad. Preferably, the first piece of fabric entirely encloses the coil spring, and the second piece of fabric is arranged to partly enclose the first compartment, and to be secured to the first piece of fabric.

In a preferred embodiment, the second piece of fabric is secured to the first piece of fabric along a few transverse connection lines extending parallel to the longitudinal direction of the coil spring, said connecting lines preferably consisting of a surface joint, such an adhesive, a weld or the like. Hereby, connection of the second piece of fabric may easily be incorporated in the conventional pocket spring manufacturing process.

However, alternatively, the first compartment and the second compartment may be formed by a single piece of fabric. For example, it is possible to arrange the fabric in an S-shape to form separate compartments, as is disclosed in U.S. Pat. No. 6,397,418 by the same applicant, said document hereby being incorporated in its entirety by reference.

The coil spring preferably comprises an upper end turn, a lower end turn and a plurality of convolutions between said end turns. Preferably, the coil spring comprises 2-10 convolutions, and most preferably 5-8 convolutions.

The individually pocketed coil spring may further comprise a second cushioning pad located below said lower end of said coil spring, said second cushioning pad being arranged in a third compartment, said third compartment being separated from said first and second compartments. Thus, each pocket unit hereby contains two cushioning pads located above and below the end turns of the coil spring. Hereby, cushioning pads will be provided at both sides of the mattress, which makes the mattress useable with both sides turned upwards. The cushioning pads at both ends may be identical or similar, thereby providing equal properties on both sides. This will increase the longevity of the pocket units and the mattress. However, the cushioning pads may also be different, thereby providing a choice for the user between different properties by selecting which side to use as the upper side.

The at least one cushioning pad preferably includes at least one piece of foam, and preferably foam made of urethane or latex. The at least one cushioning pad preferably comprises a piece of cloth secured to a piece of foam.

Preferably, each cushioning pad comprises at least one piece of foam. The cushioning pad may e.g. be a piece of urethane or latex foam, and optionally sandwiched between one or two pieces of cloth. However, it is within the contemplation of the present invention that the cushioning pad comprise multiple pieces of foam. In addition to foam, other materials such as cotton may be used to form the cushioning pad.

The at least one cushioning pad preferably has a square configuration. Hereby, the cushioning pads will cover essentially the whole upper surface of a mattress formed by such pocket units. However, alternatively the cushioning pads may have a circular, hexagonal, octagonal shape, and many other geometrical configurations are feasible.

The casing is preferably made of a weldable textile material.

According to another aspect of the present invention, there is provided a pocket spring mattress for use in a bedding or seating product, comprising a plurality of parallel strings of individually pocketed coil springs, wherein at least one, and preferably essentially all, of said individually pocketed coil springs is an individually pocketed coil spring of the type discussed above.

By means of this additional aspect of the invention, similar objects and advantages as discussed above in relation to the first aspect of the invention are obtainable.

Thus, the pocketed bedding or seating product of the present invention may comprise a plurality of parallel strings of individually pocketed coil springs. Adjacent strings of springs are joined to each other using conventional methods such as gluing, ultrasonic welding, or using conventional fasteners such as hog rings. The assembly of parallel strings of springs may optionally be joined to upper and lower generally rectangular border wires located in the top and bottom planes of the bedding or seating product. In order to complete the bedding or seating product of the present invention, a covering pad may optionally be placed over the spring assembly and an upholstered covering placed above the pocket spring mattress.

Each string of springs preferably comprises a row of individual coil springs, a strip of fabric surrounding the coil springs and a plurality of cushioning pads placed on top of the coil springs outside the fabric enclosing the coil springs. The strip of fabric in each string is divided into a plurality of pockets by spaced transverse lines of attachment. Each pocket contains one the coil springs, and an additional compartment above each coil spring encloses at least one cushioning pad located above the coil spring. An additional cushioning pad or pads may be located below the coil spring in an additional compartment.

In forming a string of springs, once a strip of fabric has been wrapped around a row of aligned coil springs, the longitudinal edges of the strip of fabric are joined together with a longitudinal line of attachment in any known manner, such as sewing, welding or gluing. Opposed plies of the strip of fabric on opposite sides of the coil springs are joined together between the coil springs with transverse lines of attachment, which similarly may be ultrasonic welds, sewing lines, glue lines or any other means of attaching the plies to each other. The additional compartments for housing the cushioning pads may be provided by means of additional pieces of fabric, or by wrapping of the same fabric in a way providing additional compartments.

Thus, each of the strings of individually pocketed coil springs preferably comprises a plurality of aligned coil springs, a strip of fabric surrounding said aligned coil springs, said strip of fabric being divided into a plurality of pockets by spaced transverse connecting lines, each pocket containing one coil spring.

The strip of fabric further preferably comprises at least one longitudinal connecting line extending parallel to the longitudinal direction of the string, which define said pockets together with the plurality of transverse connecting lines extending transversely to the longitudinal direction of the string.

In one embodiment, each of the strings is formed by a first piece of fabric forming said pockets, and a second piece of fabric is used to form the second compartments. In this embodiment, the second piece of fabric is preferably connected to the first piece of fabric along the spaced transverse connecting lines.

The parallel strings preferably each comprises a plurality of interconnected pocketed coil springs, and wherein the parallel strings are arranged side by side and interconnected by surface attachment between abutting surfaces, wherein the surface attachment adapted to interconnect the strings preferably comprises at least one of gluing and welding.

Other aspects, benefits and advantageous features of the invention will be apparent from the following description and claims.

BRIEF DESCRIPTION OF THE DRAWINGS

These and other aspects of the present invention will now be described in more detail, with reference to the appended drawings showing currently preferred embodiments of the invention.

DETAILED DESCRIPTION

Figure 1:
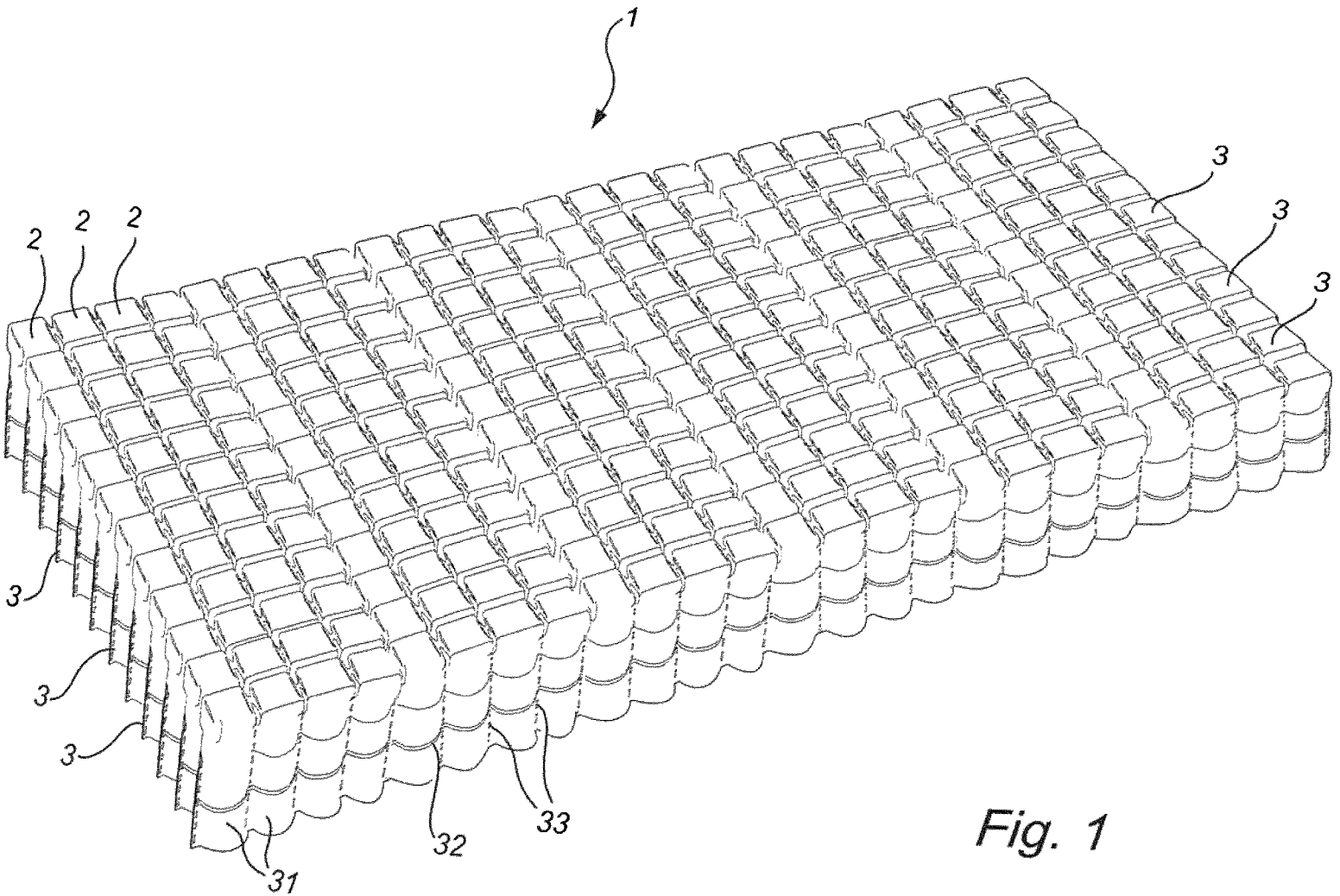
FIG. 1 shows a schematic perspective view of an embodiment of a mattress according to an embodiment of the present invention.
Figure 2:
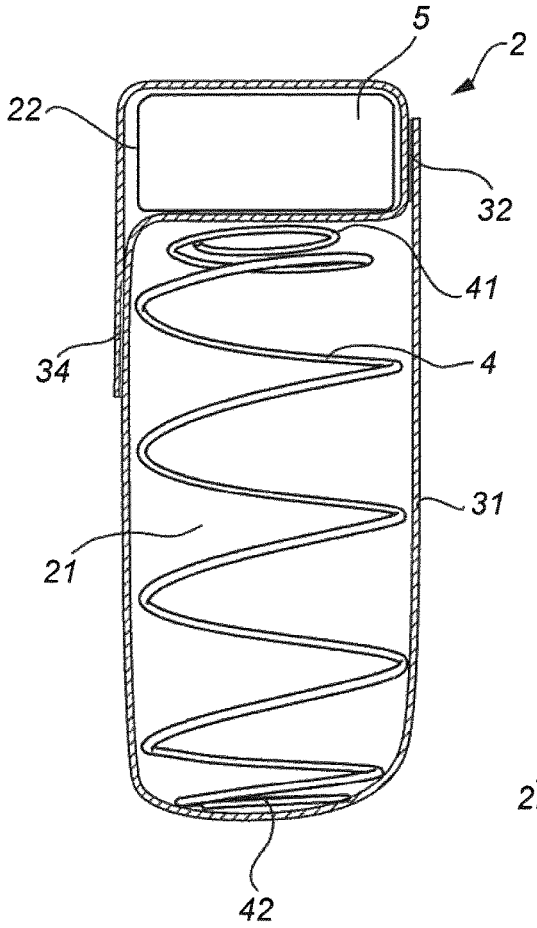
FIG. 2 shows a cross-sectional view of an individually pocketed coil spring in accordance with a first embodiment of the present invention.
Figure 3:
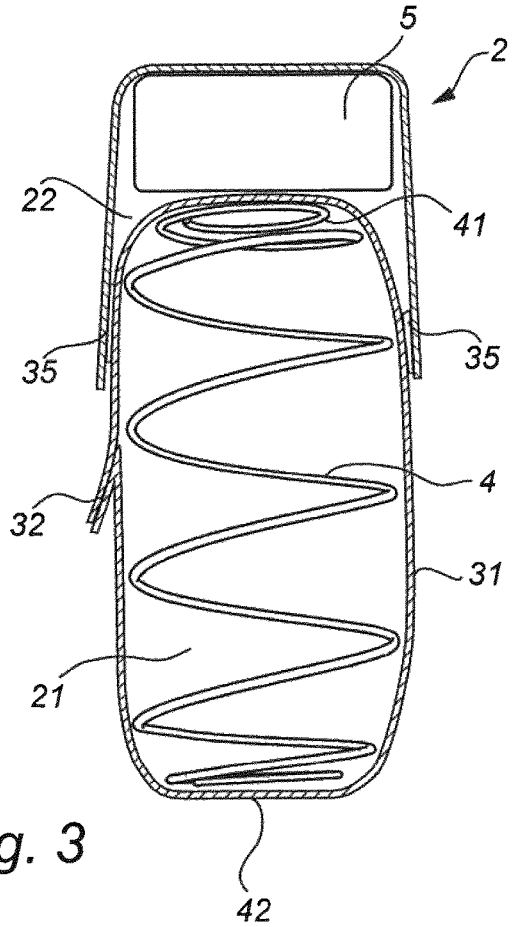
FIG. 3 shows a cross-sectional view of an individually pocketed coil spring in accordance with a second embodiment of the present invention.

With reference to FIGS. 1-3, there is illustrated a mattress 1 embodying the invention of this application. Although a mattress is illustrated, the present invention may be used to construct any bedding or seating product. This mattress 1 comprises a plurality of individually pocketed coil spring units 2.

The mattress 1 is here formed from a plurality of parallel strips or strings 3 of individually pocketed coil spring units 2. Each string 3 of pocketed coil springs 2 preferably comprises a fabric covering or strip of fabric 31 within which there is located a row or column of aligned coil springs. Individual pockets are here formed by longitudinal connecting lines 32, extending along the strings e.g. on the top or at the middle of the strings, and by transversal connecting lines 33, extending in the axial direction of the springs. Adjacent strings of springs 3 may be secured to each other by surface attachments on adjacent surfaces, such as by gluing, ultrasonic welding, hog rings or any other means.

In the above-discussed embodiments, the individually pocketed coil spring units are arranged as continuous strings, arranged side-by-side, and extending in parallel to each other, in a width or length direction of the mattress, or any other spring assembly. However, several alternative configurations are feasible. For example, the strings may occur non-linearly, in serpentine shapes or the like. Further, the individually pocketed coil spring units may be provided as single units, or shorter strings, consisting of only a few individually pocketed coil springs.

As best seen in FIGS. 2 and 3, each individually pocketed coil spring unit comprises a casing 31 forming the pocket, and providing a first compartment 21 enclosing a coil spring 4, and a second compartment 22 enclosing a cushioning pad 5. The first and second compartments are separated from each other. The coil springs each has an upper end 41 and a lower end 42. The second compartment 22 is arranged above the first compartment 21, so that the cushioning pad 5 is located above the upper end 41 of the coil spring 4. Thus, the cushioning pads may hereby be maintained in place solely by being enclosed in the compartments, without the need for any additional fixation.

In the above-discussed exemplary embodiments, two compartments are provided, and cushioning pads are provided only on one side of the mattress. However, it is also feasible to provide three or more compartments. For example, the individually pocketed coil spring units may comprise a compartment housing a cushioning pad both at the upper and lower ends of the coil springs. Hereby, cushioning pads will be provided at both sides of the mattress.

The coil spring preferably comprises an upper end turn, a lower end turn and a plurality of convolutions between said end turns. Preferably, the coil spring comprises 2-10 convolutions, and most preferably 5-8 convolutions.

Each casing/pocket contains at least one, and preferably only one, helical coil spring. The springs may have a spiral turn with a diameter of approximately 2 to 10 cm, and preferably about 6 cm. Preferably, the coil springs are barrel shaped, having upper and lower turns having a smaller diameter than the turns at the centre of the springs. However, alternatively the convolutions may all have identical diameter, or may have other variations in diameters. For example, the coil springs may be in the form of an hour-glass-shaped coil spring or any other shapes of springs.

The cushioning pads may be formed by a single material, or by several different materials. For example, the cushioning pads may have a layered structure, e.g. comprising a foam center piece, an upper fabric piece and a lower fabric piece. The upper and lower fabric pieces may be glued or otherwise secured to the upper and lower surfaces of the foam center piece. Alternatively, the cushioning pad may comprise a single or multiple pieces of foam with or without any cloth pieces. The foam piece may be made of polyurethane, latex or any other conventional foam material. Alternatively, pads of cotton or any other material may be used. Pads of gel or the like may also be used, optionally enclosed in envelopes.

Although the cushioning pads are illustrated as being generally square in shape, they may alternatively be any other shape or configurations, such as foam cylinders, rectangles or any other desired shape. Similarly, the height of the cushioning pads may be varied as deemed appropriate and suitable for any particular application.

Different cushioning pads and/or coil springs may also be used in different individually pocketed coil spring units, in order to provide various properties in different parts of the mattress. This may e.g. be used to form zones having different properties in the mattress.

As illustrated in FIG. 1, the mattress 1 has a generally planar top surface, formed by the individually resilient cushioning pads. The compartments in the casing may be provided in various ways, and two exemplary embodiments are illustrated in FIGS. 2 and 3.

In the embodiment of FIG. 2, the first compartment and the second compartment are formed by a single piece of fabric. The casing material is here arrange in an S-shape to form the separate compartments, in a way similar to the disclosure in U.S. Pat. No. 6,397,418 by the same applicant, said document hereby being incorporated in its entirety by reference. A first part of the casing material forms the first compartment 21, and the compartment is closed by the longitudinal connecting line 32, being arranged at the side of the unit. Part of the material extends past the longitudinal connecting line 32, and is brought back towards the other side of the unit, and connected to the side of the first compartment 21 by means of a second longitudinal connecting line 34. Hereby, the second compartment 22 is formed on top of the first compartment 21.

In an alternative embodiment, illustrated in FIG. 3, a first piece of casing material is used to form the first compartment, and a second piece of fabric forms the second compartment. Thus, in this embodiment the first piece of casing material forms conventional pockets for pocketing coil springs, and the second piece of fabric forms the additional second compartment for housing of the cushioning pad.

The first piece of fabric hereby preferably entirely encloses the coil spring, and the second piece of fabric is arranged to be placed over the top of the first compartment, partly enclosing the first compartment, and to be secured to the first piece of fabric.

The second piece of fabric may be connected to the first compartment by means of longitudinal connection lines 35, and/or by means of transverse connection lines. In a preferred embodiment, the second piece of fabric is secured to the first piece of fabric only along transverse connection lines extending parallel to the longitudinal direction of the coil spring. These transverse connection lines may coincide with the transverse connection lines 33 separating the pockets housing the coil springs, and may be formed simultaneously with and/or by these transverse connection lines 33. Hereby, connection of the second piece of fabric may easily be incorporated in the conventional pocket spring manufacturing process.

The above-discussed connection lines, arranged longitudinally or transversely, preferably consist of a surface joint, such an adhesive, a weld or the like. The connection lines may be arranged as continuous straight or non-straight lines, or as discontinuous lines, comprising dots or the like arranged along a line.

Figure 4:
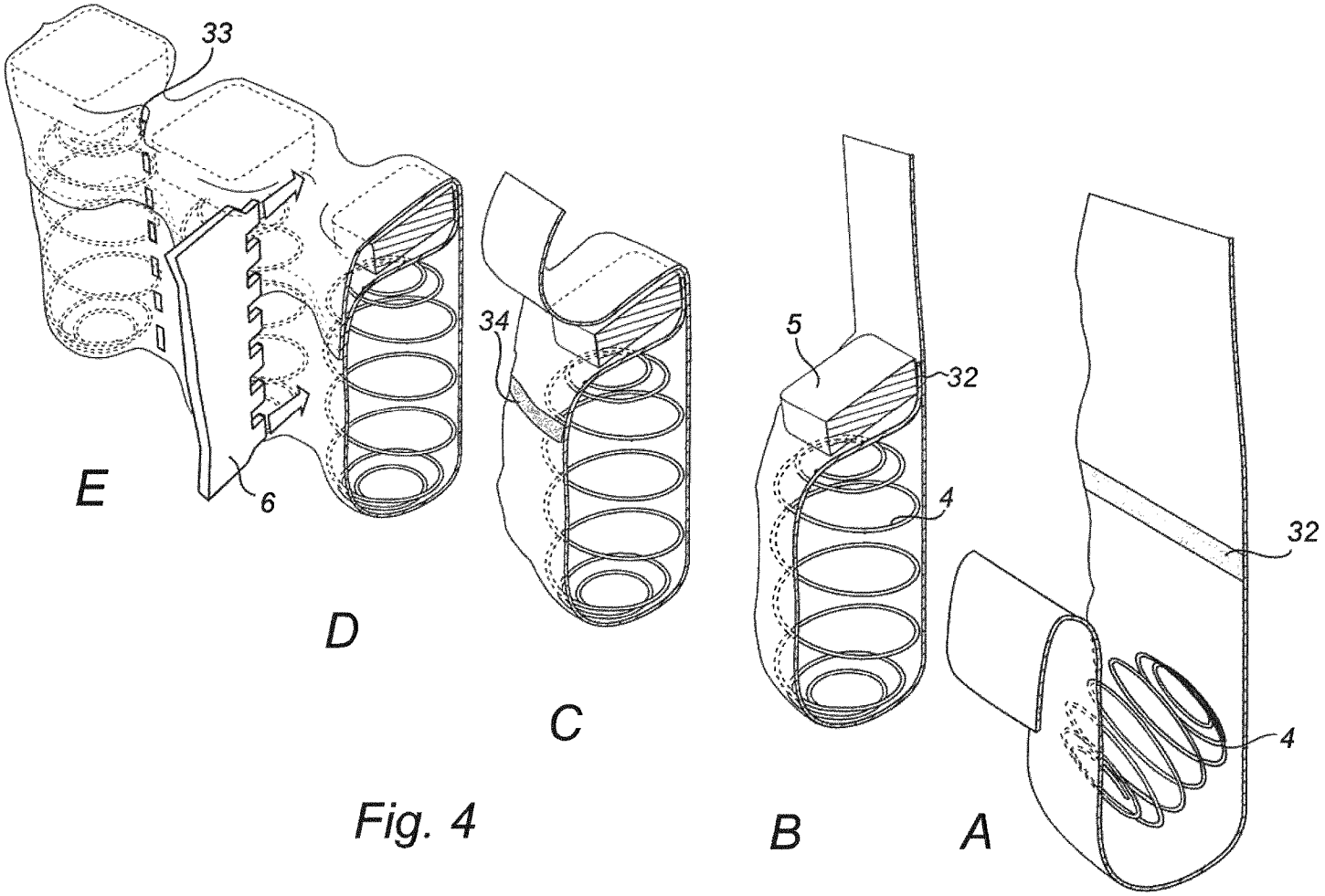
FIG. 4 is a schematic and partly cross-sectional perspective view, illustrating various method steps for the production of the individually pocketed coil springs of FIG. 2.

In FIG. 4, there is shown a schematic production method and production device for producing a continuous string of individually pocketed coil springs of the type discussed above with reference to FIG. 2.

First, a continuous fabric is folded or wrapped to form two plies of fabric connected to each other at one side. Alternatively, two separate plies of fabric may be connected to each other at one side. Compressed coil springs are inserted between the plies, as is shown at position A. Thereafter, the plies are connected to each other at the open end, along a longitudinal connection line 32, thereby encircling the inserted coil spring. In this position, the coil springs may be turned, if inserted in a rotated position, and allowed to expand. One of the plies extends past the connection line 32. Thereafter, a cushioning pad 5 is arranged on top of the enclosed coil spring. This stage is shown at position B. The extended ply is thereafter wrapped over the cushioning pad, as is shown at position C.

The wrapped ply may be connected at the other side along a longitudinal connection line 34. However, it is also feasible to connect the wrapped over ply only by transverse connection lines. This state is illustrated in FIG. D.

Thereafter, the transverse connection lines 33 are formed, dividing the string into separate pockets, so that each individual unit comprises two compartments, and so that each compartment comprises only one coil spring or only one cushioning pad. This state is illustrated in Fig E. The transverse connection lines 33 here serve the double purposes of both separating the compartments housing the coil springs from each other, and connecting the material forming the second compartments to the first compartments.

The transverse connection lines 33 may e.g. be formed by welding. E.g. it is possible to use a heating element 6, and preferably an ultrasonic heating element, which is moveable towards the string, thereby applying heat to form weld at desired positions. However, other ways of forming welds are also feasible, as is well known to the skilled addressee.

Figure 5A:
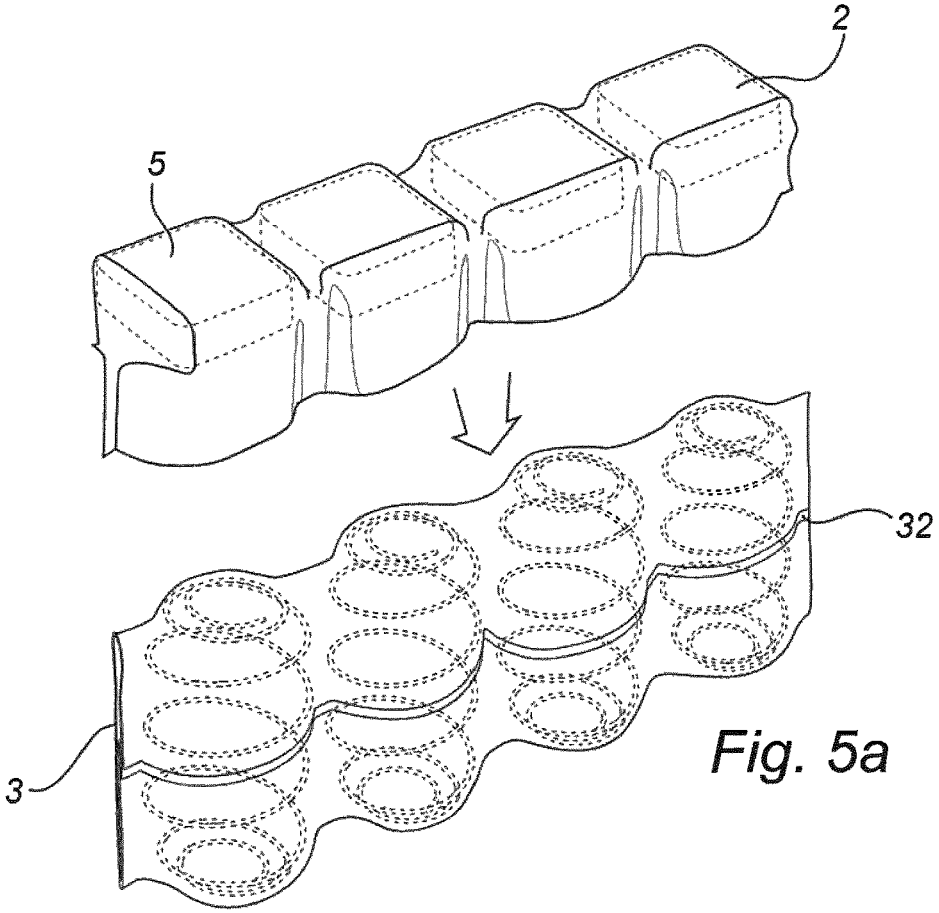
FIGS. 5*a* and 5*b* are schematic perspective views, illustrating various method steps for the production of the individually pocketed coil springs of FIG. 3.
Figure 5B:
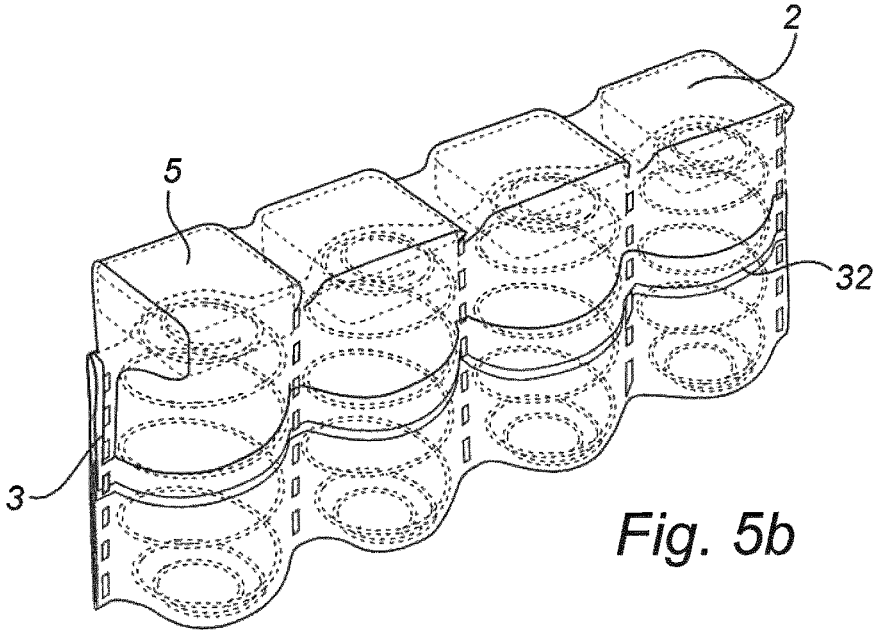

In FIG. 5, there is shown a schematic production method and production device for producing a continuous string of individually pocketed coil springs of the type discussed above with reference to FIG. 3.

First, a continuous fabric is folded or wrapped to form two plies of fabric connected to each other at one side. Alternatively, two separate plies of fabric may be connected to each other at one side. Compressed coil springs are inserted between the plies. Thereafter, the plies are connected to each other at the open end, along a longitudinal connection line 32, thereby encircling the inserted coil spring. In this position, the coil springs may be turned, if inserted in a rotated position, and allowed to expand. This state is shown schematically in FIG. 5*a*.

Thereafter, a second piece of fabric is provided above the coil springs, and cushioning pads are provided between the enclosed coil springs and the second piece of fabric. This is also shown schematically in FIG. 5*a*.

The second piece of fabric is wrapped over the cushioning pads and over the top of the enclosed coil springs. Thereafter, the transverse connection lines 33 are formed, dividing the string into separate pockets, so that each individual unit comprises two compartments, and so that each compartment comprises only one coil spring or only one cushioning pad. The transverse connection lines 33 here serve the double purposes of both separating the compartments housing the coil springs from each other, and connecting the second material forming the second compartments to the first compartments. This is illustrated schematically in FIG. 5*b*.

As in the previous example, the transverse connection lines 33 may e.g. be formed by welding. E.g. it is possible to use a heating element, such as an ultrasonic weld equipment, which is moveable towards the string, thereby applying heat to form weld at desired positions. However, other ways of forming welds are also feasible, as is well known to the skilled addressee.

Each transverse line of attachment 33 preferably extends generally from an upper surface of the string of springs to a lower surface of the string of springs, and thus extends approximately the entire height of the string of springs. However, the transverse lines of attachment 33 may be any desired length. In addition, multiple transverse lines of attachment 33 may exist between adjacent pockets.

Figure 6:
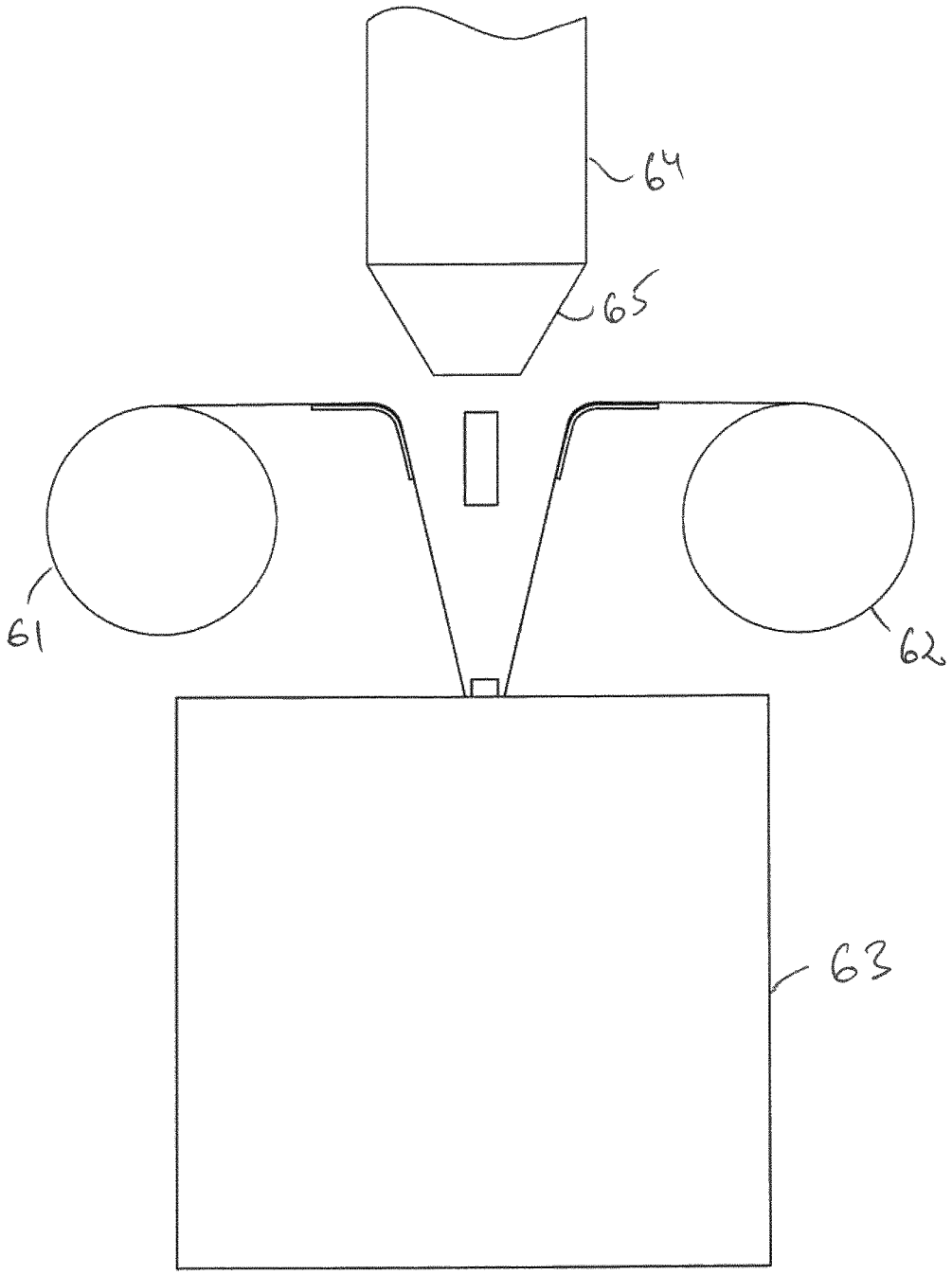
FIG. 6 is a schematic view illustrating a manufacturing apparatus for use in conjunction with the method illustrated in FIG. 5.

The first and second piece of fabric may be provided continuously and simultaneously, as is shown schematically in FIG. 6. Thus, the first fabric may be provided from a first roll 61 of material, and the second fabric may be provided from a second roll 62 of material. The fabrics are then guided into a manufacturing apparatus 63 where the materials are formed into pockets each having two compartments, in the way discussed above. The cushioning pads are preferably provided between the sheets of fabric. For example, pre-cut cushioning pads may be provided in a magazine 64 or other form of supply, and be dispensed between the two sheets of fabric by a dispenser 65 or the like. Alternatively, the cushioning pads may be provided as a continuous string, which is cut into suitable lengths immediately prior to being dispensed.

By this arrangement, correct positioning of the cushioning pads is enabled in a very convenient and efficient manner. The cushioning pads will be moved along with the sheets of fabric during the entire manufacturing process, and will be held and maintained in a correct position by the friction of the sheets.

Thus, in both the above-discussed methods, it is possible to use a conventional manufacturing process for making pocket mattresses, and to simply add a separate compartment on top of each pocket unit to incorporate the cushioning pad. Hereby, the present invention lends itself very well to automated and cost-efficient manufacturing, and it is also relatively simple to incorporate the additional steps of providing a separate compartment for the cushioning pad and to insert such cushioning pads into said compartments in previously known and used manufacturing processes.

To form a pocket spring mattress for use in a bedding or seating product, comprising a plurality of parallel strings of individually pocketed coil springs, strings formed as discussed above may be connected together, side-by-side, e.g. by providing surface attachments between adjacent surfaces. For example, it is possible to use glue, Velcro, ultrasonic welding, clamps or the like to connect such strings.

The assembly of parallel strings of springs may optionally be joined to upper and lower generally rectangular border wires located in the top and bottom planes of the bedding or seating product. In order to complete the bedding or seating product of the present invention, a covering pad may optionally be placed over the spring assembly and an upholstered covering placed above the pocket spring mattress.

Each string of springs preferably comprises a row of individual coil springs, a strip of fabric surrounding the coil springs and a plurality of cushioning pads placed on top of the coil springs outside the fabric enclosing the coil springs. The strip of fabric in each string is divided into a plurality of pockets by spaced transverse lines of attachment. Each pocket contains one the coil springs, and an additional compartment above each coil spring encloses at least one cushioning pad located above the coil spring. An additional cushioning pad or pads may be located below the coil spring in an additional compartment.

The person skilled in the art realizes that the present invention by no means is limited to the preferred embodiments described above. On the contrary, many modifications and variations are possible within the scope of the appended claims. For instance, more than one cushioning pad may be arranged in each individually pocketed coil spring unit. Further, the individually pocketed coil spring units may be assembled in various ways, in the form of parallel strings, strings arranged in various patterns, or by separate individual units. Further, the separate compartments of the units may be formed in various ways, e.g. by a single piece of fabric, or by two or more separate pieces of fabric. Such and other modifications of the pocket units and the mattress formed by such units form part of the present invention, as it is defined in appended claims.

The invention claimed is:

1. An individually pocketed coil spring for use in a bedding or seating product, said individually pocketed coil spring comprising: a coil spring having an upper end and a lower end; a first casing formed from a first single piece of fabric and forming a pocket enclosing said coil spring; a second casing formed from a second single piece of fabric; and a cushioning pad located above said upper end of the coil spring; wherein the first casing provides a first compartment enclosing the coil spring, and the second casing provides a second compartment enclosing the cushioning pad, said first and second compartment being separated from each other by a portion of the first casing, and wherein the second single piece of fabric is secured to the first single piece of fabric at free ends of the second single piece of fabric along opposing sides of an upper half of the first casing along transverse connection lines extending parallel to a longitudinal direction of the coil spring, said connection lines comprising surface joints.

2. The individually pocketed coil spring of claim 1, wherein the first single piece of fabric entirely encloses the coil spring, and the second single piece of fabric is arranged to partly enclose the first compartment, and to be secured to the first single piece of fabric.

3. The individually pocketed coil spring of claim 1, wherein the coil spring comprises an upper end turn, a lower end turn and a plurality of convolutions between said end turns.

4. The individually pocketed coil spring of claim 1, wherein the cushioning pad includes at least one piece of foam.

5. The individually pocketed coil spring of claim 1, wherein the cushioning pad has a square configuration.

6. The individually pocketed coil spring of claim 1, wherein the cushioning pad comprises a piece of cloth secured to a piece of foam.

7. The individually pocketed coil spring of claim 1, wherein the first casing is a weldable textile material.

8. A pocket spring mattress for use in a bedding or seating product, comprising a plurality of parallel strings of individually pocketed coil springs, wherein at least one of said individually pocketed coil springs is the individually pocketed coil spring of claim 1.

9. The pocket spring mattress of claim 8, wherein each of said strings of individually pocketed coil springs includes a plurality of aligned coil springs, the first casing surrounding said aligned coil springs, said first casing being divided into a plurality of pockets by spaced transverse connecting lines, each pocket containing one coil spring.

10. The pocket spring mattress of claim 9, wherein said first casing further comprises at least one longitudinal connecting line extending parallel to a longitudinal direction of the string, which define said pockets together with the plurality of transverse connecting lines extending transversely to the longitudinal direction of the string.

11. The pocket spring mattress of claim 9, wherein each of said strings is formed by the first single piece of fabric forming said pockets, and the second single piece of fabric forming said second compartments.

12. The pocket spring mattress of claim 8, wherein the parallel strings each comprises a plurality of interconnected pocketed coil springs, and wherein the parallel strings are arranged side by side and interconnected by surface attachment between abutting surfaces.

13. The individually pocketed coil spring of claim 1, wherein the surface joint is an adhesive or a weld.

14. The individually pocketed coil spring of claim 4, wherein the at least one piece of foam is made of urethane or latex.

15. The pocket spring mattress of claim 8, wherein all of said individually pocketed coil springs are individually pocketed coil springs in accordance with claim 1.

16. The pocket spring mattress of claim 12, wherein the surface attachment is adapted to interconnect the strings comprises at least one of gluing and welding.

17. The individually pocketed coil spring of claim 1, wherein the first casing forms an external cover of the first compartment and a partition wall between the first compartment and the second compartment, and extending between the coil spring and the cushioning pad, thereby separating the first and second compartments, wherein a length of an extension of the partition wall between junctions between the external cover of the first compartment and an external cover of the second compartment exceeds that of a diameter of the coil spring and a width of the cushioning pad.

18. The individually pocketed coil spring of claim 1, wherein the second single piece of fabric covers an exterior portion of the first single piece of fabric and the transverse connection lines are formed in an overlapped portion.

* * * * *